US007076984B2

(12) United States Patent
Cappello et al.

(10) Patent No.: US 7,076,984 B2
(45) Date of Patent: Jul. 18, 2006

(54) BENDING MACHINE AND TUBE SUPPORT AND DRIVE DEVICE THEREOF

(75) Inventors: Serge Cappello, Taluyers (FR); Jean-Paul Chastan, Ecully (FR); Jean-Paul Bruyas, Charly (FR)

(73) Assignee: Silfax SA, Vourles (FR)

( * ) Notice: Subject to any disclaimer, the term of this patent is extended or adjusted under 35 U.S.C. 154(b) by 0 days.

(21) Appl. No.: 10/515,312

(22) PCT Filed: May 20, 2003

(86) PCT No.: PCT/FR03/01518

§ 371 (c)(1),
(2), (4) Date: Nov. 23, 2004

(87) PCT Pub. No.: WO03/099483

PCT Pub. Date: Dec. 4, 2003

(65) Prior Publication Data

US 2005/0210946 A1 Sep. 29, 2005

(30) Foreign Application Priority Data

May 24, 2002 (FR) ..... 02 06380

(51) Int. Cl.
*B21D 9/05* (2006.01)

(52) U.S. Cl. ..... 72/250; 72/369

(58) Field of Classification Search ..... 72/150, 72/369, 466.2
See application file for complete search history.

(56) References Cited

U.S. PATENT DOCUMENTS 2,996,100 A * 8/1961 Newhall et al. ..... 72/369
3,533,266 A * 10/1970 Anderson ..... 72/298
5,823,031 A * 10/1998 Campbell et al. ..... 72/58
6,009,737 A 1/2000 Bandy
6,155,091 A 12/2000 Hayes et al.

OTHER PUBLICATIONS

Patent Abstracts of Japan, vol. 008, No. 166 (M-314), Aug. 2, 1984 & JP 59 061526 A (Mitsubishi Jukogyo KK), Apr. 7, 1984 abstract.

* cited by examiner

*Primary Examiner*—Lowell A. Larson
(74) *Attorney, Agent, or Firm*—Dowell & Dowell, P.C.

(57) ABSTRACT

A bending machine that includes a device that is used to drive and support a tube that is to be bent in relation to a bending head which is disposed at one end of a frame of the bending machine. The device includes a mandrel member that is solidly connected to an expandable member that is selectively applied against an inner wall of the tube to be bent and movement means that is used to align the mandrel member relative to a section of the tube to be bent during a bending step and that moves the expandable member to move the tube in translation and/or rotation between bending steps and when the expandable member is expanded to engage the inner wall of the tube.

9 Claims, 7 Drawing Sheets

BENDING MACHINE AND TUBE SUPPORT AND DRIVE DEVICE THEREOF

BACKGROUND OF THE INVENTION

1. Field of the Invention

The present invention relates to device for retaining a tube on a bending machine and more particularly to a device for selectively retaining or moving the tube relative to a bending head of the machine.

2. Brief Description of the Related Art

There are known tube bending machines which comprise an elongated frame along which moves a first movable carriage secured to a gripper for holding the tube to be bent, a second carriage movable independently of the first and carrying a mandrel or mouse disposed within the tube and a bending head.

The first movable carriage comprises a gripper which grips the tube to be bent to move it in longitudinal translation and/or rotation, as a function of pre-selected positions relative to tools carried by a bending head.

For a bending operation, the first movable carriage advances and turns the tube about its longitudinal axis to position it relative to the bending tools carried by the bending head. The second movable carriage positions, within the tube and in the bending zone, the mandrel or a mouse to ensure the bending of the tube and to avoid its flattening during deformation.

Thus, gripping and bending tools coact so as to grip a forward portion of the tube in which the mandrel or mouse is not located. The gripping and bending tools are driven simultaneously in rotation about a substantially vertical axis to permit the bending of the tube. This gives rise to the curving of the tube about the bending tool.

After the tube is bent, the tools are retracted, the first movable carriage is advanced to position the tube for a new bending operation and the second movable carriage is moved to withdraw the mandrel or its mouse from its position within the tube.

The assembly of the bending head comprises an assembly with a fixed arm in which is mounted the mechanism for driving in rotation the bending tool. On the stationary arm is also mounted the mechanism for actuating the pressing tool. An assembly with a swinging bending arm is mounted on the assembly with a fixed arm so as to be secured in rotation to the bending tools about the axis of these latter, and this assembly carries gripping tools and their actuating mechanism.

The machine is preferably controlled entirely automatically so as to carry out a series of bending operations on a given tube.

SUMMARY OF THE INVENTION

The drive and retaining device according to the present invention has for its object to ensure simultaneously on the one hand the movements in longitudinal translation and rotation of the tube or pipe to be bent, and on the other hand the positioning of the mandrel or the mouse within the tube or pipe to permit the bending of this latter.

The drive and retaining device according to the present invention comprises a guide mandrel secured to gripping means that will be applied against the internal wall of the tube to be bent, and movement means which are common to the mandrel and to the gripping means.

The drive and retaining device according to present invention comprises gripping means which are connected to a movable carriage by way of a bar that also supports a mandrel.

The drive and retaining device according to the present invention comprises gripping means which are constituted by a gripper that can be deformed by hydraulic or pneumatic control means, so as to be able to exert a sufficient pressure force against the internal wall of the tube and to block this latter in the bending position.

The drive and retaining device according to the present invention comprises a gripper which is constituted by fingers that move axially to increase the external diameter of said gripper.

The drive and retaining device according to the present invention comprises a gripper which is constituted by a sealed envelope of elastomer which is elastically deformable to increase the external diameter of said gripper.

The drive and retaining device according to the present invention comprises a mandrel which is constituted by a solid bar, at one of its ends, with deformable cups ensuring the deformation of the tube during its bending.

The drive and retaining device according to the present invention comprises a mandrel whose solid bar is secured at the end opposite that carrying the cups of a gripper.

The drive and retaining device according to the present invention comprises a mandrel whose solid bar is secured, at the end opposite that carrying the cups, to a connecting bar permitting connection with a gripping member.

BRIEF DESCRIPTION OF THE DRAWINGS

The description which follows with respect to the accompanying drawings, given by way of non-limiting example, will permit better understanding of the invention, the characteristics that it provides and the advantages which it is adapted to supply.

DESCRIPTION OF THE PREFERRED EMBODIMENTS

Figure 1:
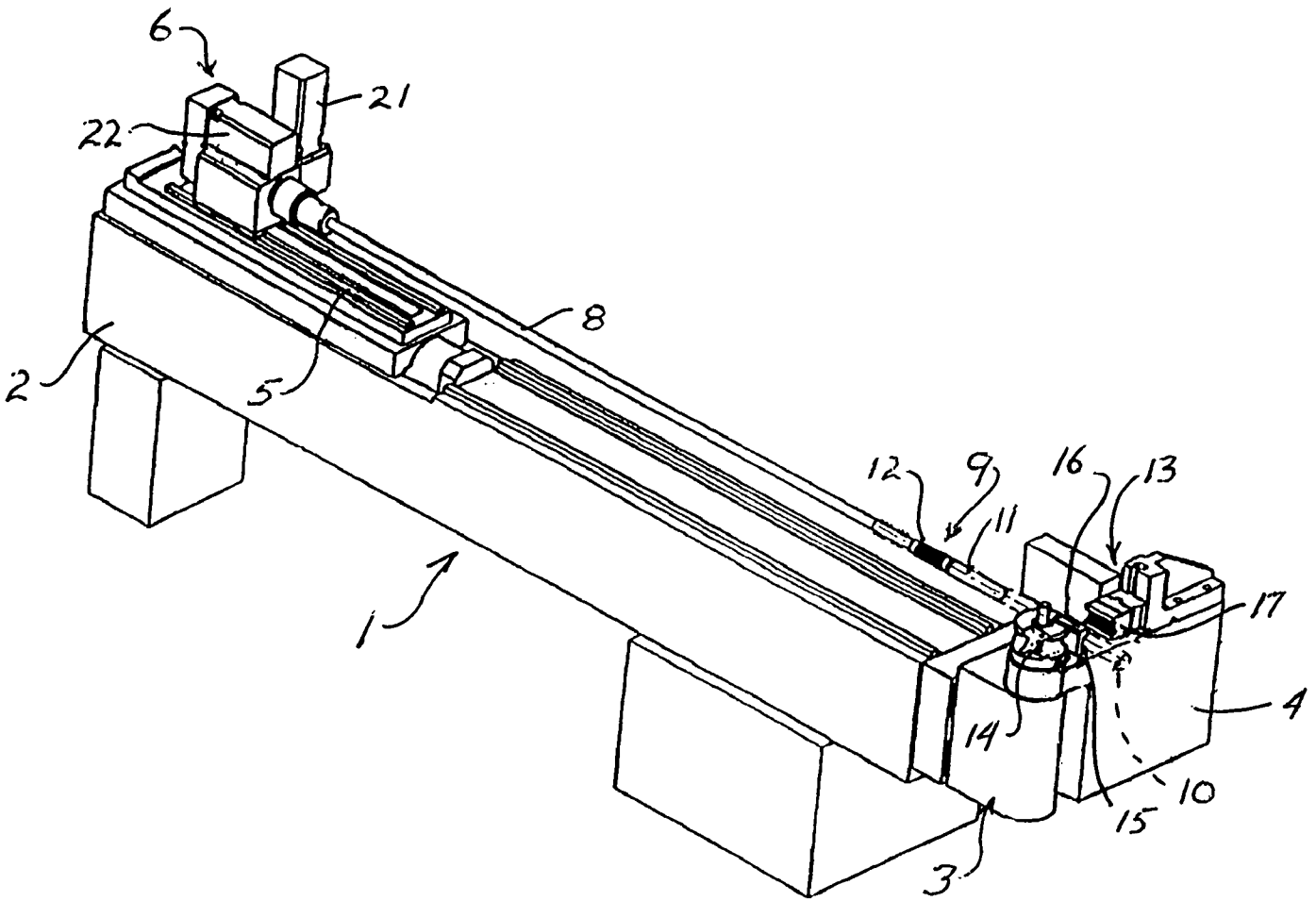
FIG. 1 is a perspective view showing a machine for bending tubes or pipes and its gripping device, according to the present invention.

There is shown in FIG. 1 a bending machine 1 comprising a fixed frame 2 which carries at one of its ends a bending head 3 about which pivots a bending arm 4.

The fixed frame 2 comprises, opposite the bending head 3 and along its longitudinal axis, a guide rail 5 on which slides the carriage 6 which moves toward and away from the bending head 3.

The carriage 6 comprises securement means 7 for the reception and securement of a bar 8, which is moved in translation and in rotation about its axis.

The bar 8 comprises, at its free end and opposite an end retained by the securement means 7, a gripping device 9 that is operable to function as a releasable connector to engage a tube or pipe prior to and after bending in order to permit movements in longitudinal translation and in rotation of the tube of pipe 10 and to disengage the tube or pipe to permit the positioning of a mandrel 11 or mouse within the tube or pipe 10 to be bent and wherein the movements of the tube or pipe and the mandrel are under a common drive source.

The gripping device 9 is constituted by an internal gripping member 12 which can be integrated or not with the mandrel 11.

The bending arm 4 comprises a jaw support 14 which moves horizontally in the direction of the bending head 3.

The bending arm 4 is secured to a bending roller 14 constituting a securement device for one of the jaws 16 of a gripping jaw 15, the other jaw 17 being fixed on the jaw support 13 of the bending arm 4.

The bending head 3 can comprise movement means, to be able to move it horizontally and vertically relative to the fixed frame 2, which is to say in directions located in a plane perpendicular to that containing the longitudinal axis of the machine 1 or the fixed frame 2, which is generally defined by the tube 10 to be bent.

Figures 2, 3, 4, 5, 6, 7:
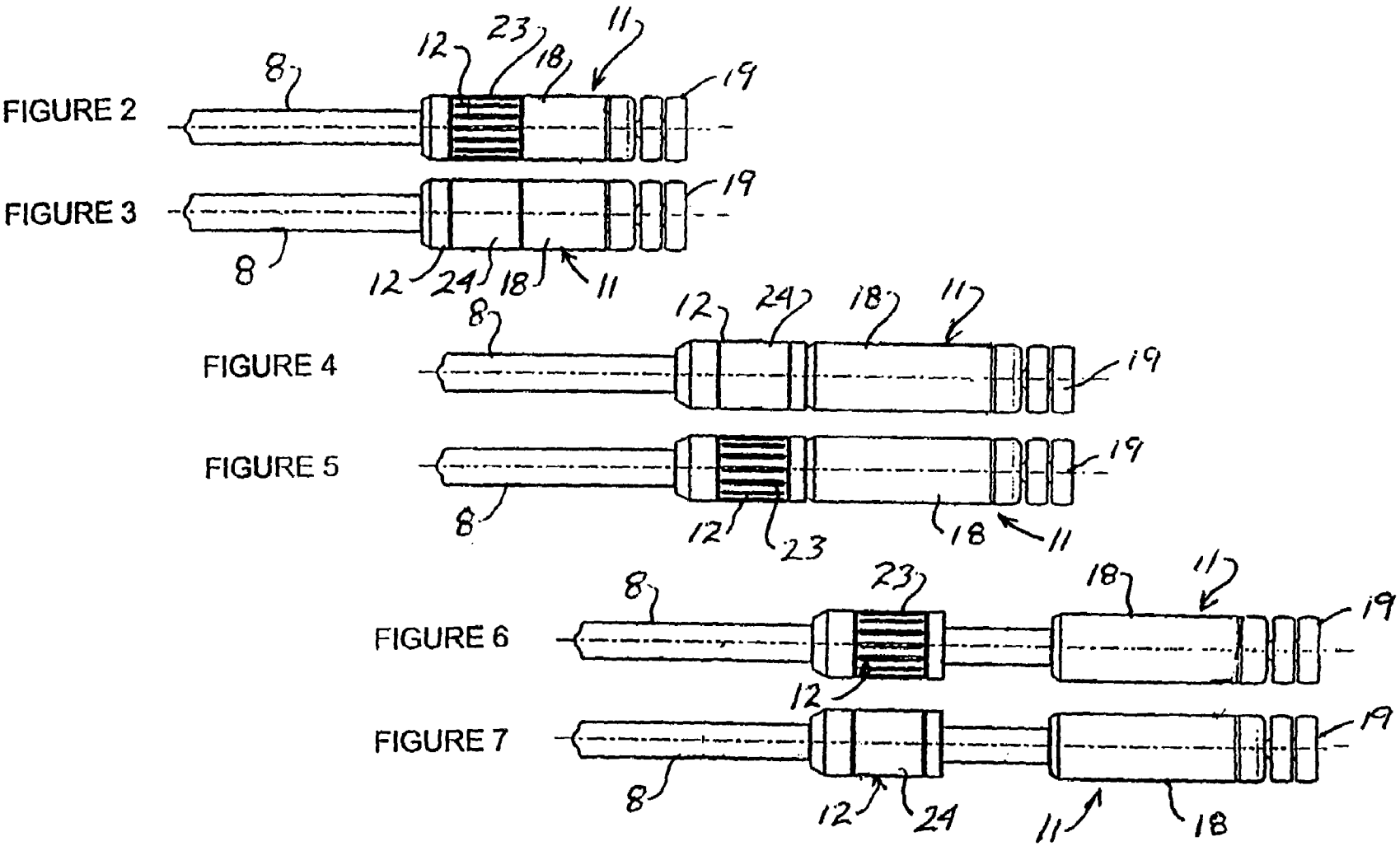
FIGS. 2 to 7 are views showing different modifications of embodiments of the gripping device according to the present invention.

In FIGS. 2 and 3 there is shown the gripping device 9 according to the present invention comprising a mandrel or mouse 11 which is fixed on the mandrel carrying bar 8, so as to ensure movement and bending of the tube 10.

The mandrel 11 is constituted by a solid bar 18 terminating at one of its ends in a series of cups or rollers 19 mounted on an axle adapted to deform during bending of the tube 10. The cups or rollers 19 are adapted to ensure the constant deformation of the tube 10 without rupture.

The bar 18 comprises, opposite the cups 19, a gripper 12 which will bear, after opening or resilient deformation, against the internal wall of the tube 10 so as to ensure on the one hand the holding of this latter and on the other hand the horizontal and rotary movements relative to the fixed frame 2 of the bending machine 1.

The gripping member 12 is constituted by expansible means such that its external diameter will increase to press against and be gripped against the internal wall of the tube 10 to be bent.

The gripping member 12 can be deformed by hydraulic or pneumatic control means, so as to be able to exert a sufficient pressure force to block the tube 10 in the bending position.

According to this embodiment, the gripping device 9 constitutes the mandrel 11 and the gripper 12 in one piece.

In FIGS. 4 and 5, there is shown a first modification of the gripping device 9 whose mandrel 11 is separated from the gripper 12 to constitute two separate members. In this modification, the gripper 12 is disposed against the mandrel 11 to prolong the latter axially.

In FIGS. 6 and 7, there is shown a second modification of the gripping device 9 according to the present invention, whose mandrel 11 forms a member independent from the gripper 12. In this modification, the gripper 12 is connected to the mandrel 11 by a connecting bar 20.

The gripping device 9 according to the present invention permits, during the steps of bending the tube 10, the gripping member 12 to function as a releasable connector such that, when expanded into engagement with the tube, the carriage 6 may be used to control the movements in longitudinal translation and rotation of the tube 10 prior to and after bending relative to the bending head 3, and when the gripping member is not expanded, the carriage may be used to control the positioning of the mandrel 11 within the tube 10 prior to bending so as to permit the bending of the tube without deformation.

It will be noted that the bending machine 1 comprises a single movable carriage 6, in contrast to the prior art, reducing the time of movement and the bending cycles of the tube 10.

Because of this, the movable carriage 6 is provided with a first gear or motor reducer 21 that permits movements of of the carriage along the guide rail 5 of the frame 2 of the bending machine 1. The movable carriage 6 has a second gear or motor reducer 22 that controls the rotational movements of the bar 8 carrying the gripping device 9 and the mandrel 11.

The gripper 12 can be constituted by fingers 23 movable axially to increase the external diameter of said gripper (FIGS. 2, 5 and 6).

The gripper 12 can be constituted by a sealed envelope 24 of resiliently deformable elastomer to increase the external diameter of said gripper (FIGS. 3, 5 and 7).

Figure 8:
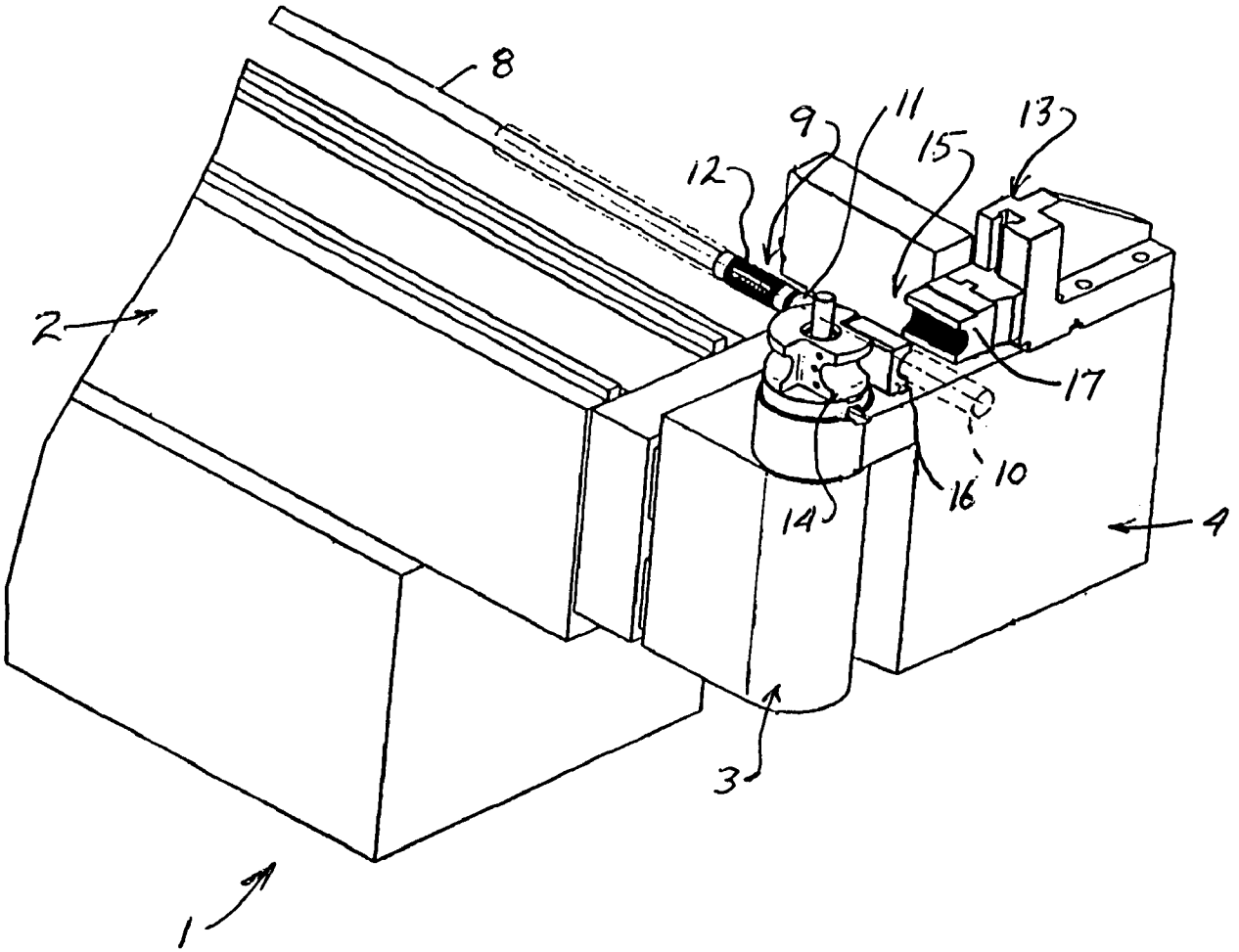
FIGS. 8 to 12 are views showing the different steps in the bending cycle of the bending machine provided with the gripping device according to the present invention.

In FIG. 8 there is shown the emplacement of the tube 10 in the jaws 16 and 17 of the gripping jaws 15 to carry out a first bend. The mandrel 11 is in position within the tube 10 to accompany this latter during bending whilst the gripper 12 is free, which is to say, it is not pressed against the internal wall of the tube 10.

Figure 9:
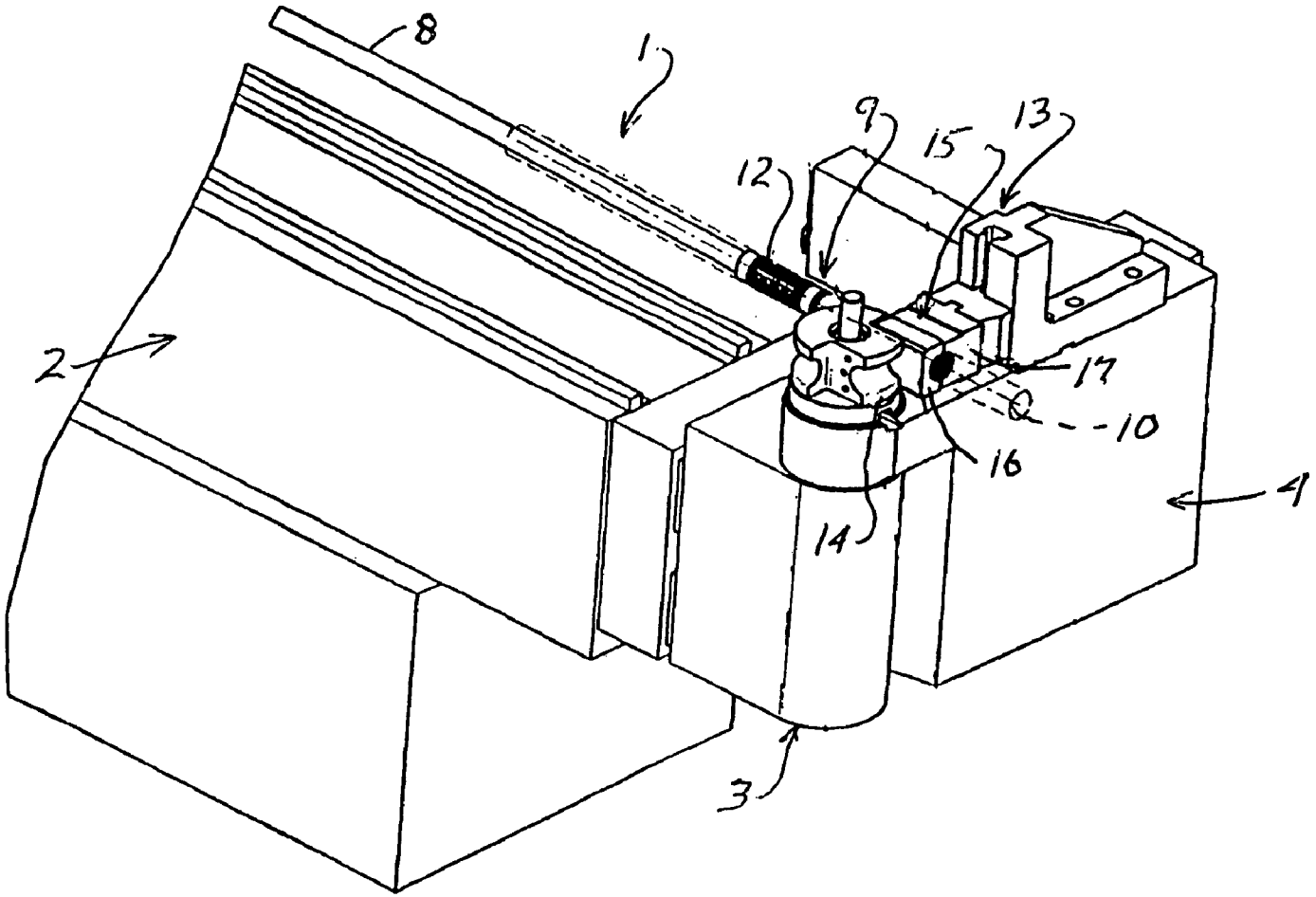

In FIG. 9 there is shown the jaws 16 and 17 of the gripping jaws 15 in closed position against the tube 10. The gripping device 9 constituted by the mandrel 11 and the gripper 12 is in the same position and in the same condition as in FIG. 8.

Figure 10:
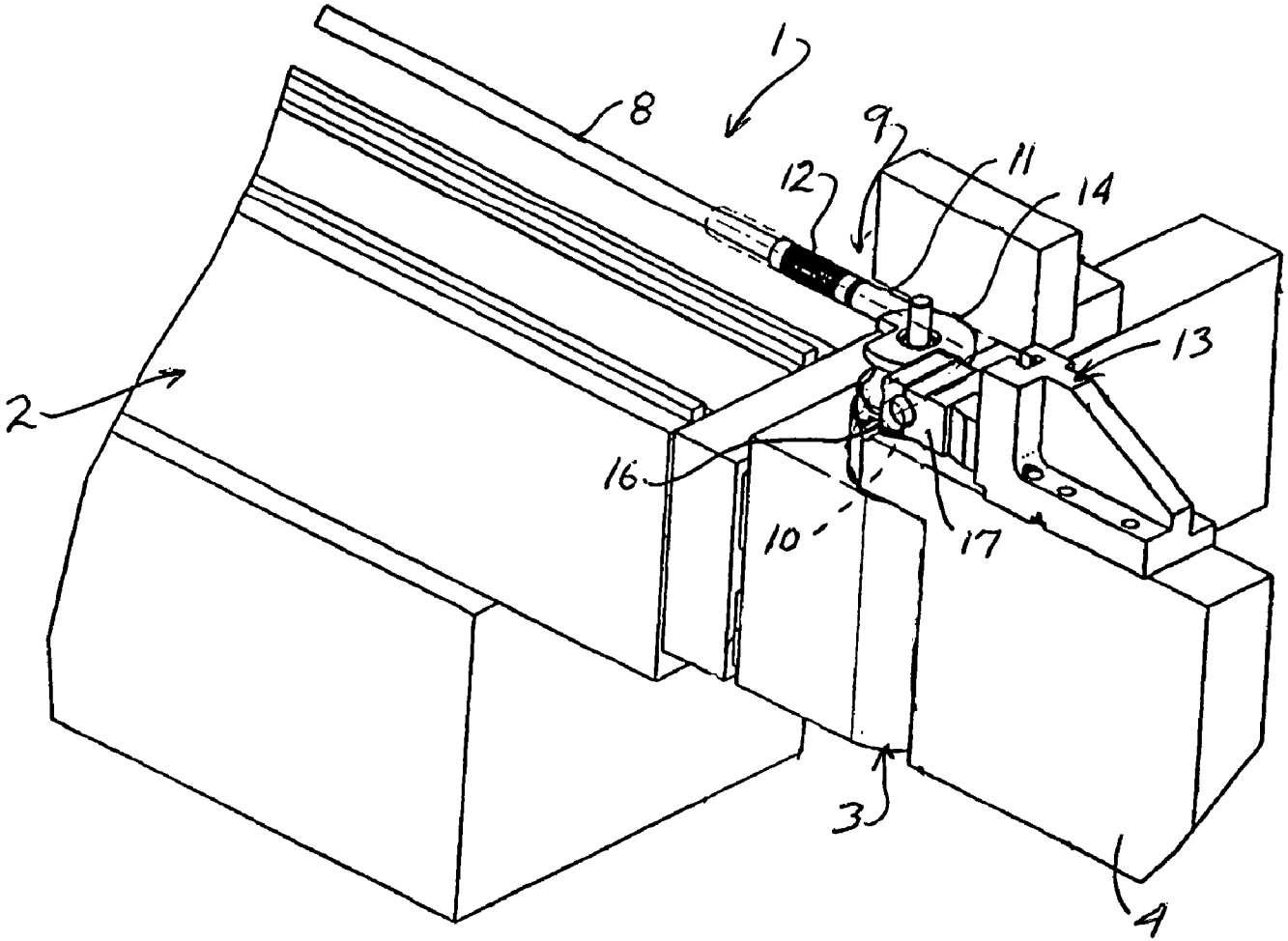

In FIG. 10 there is shown the bending of the tube 10 to the radius of curvature of the bending roller 14 after pivoting of the bending arm 4 about the bending head 3. The gripping device 9 constituted by the mandrel 11 and the gripper 12 is in the same position and in the same condition as in FIG. 8. It will be noted that because of the bending of the tube 10, the latter has advanced in the direction of the bending head 3.

Figure 11:
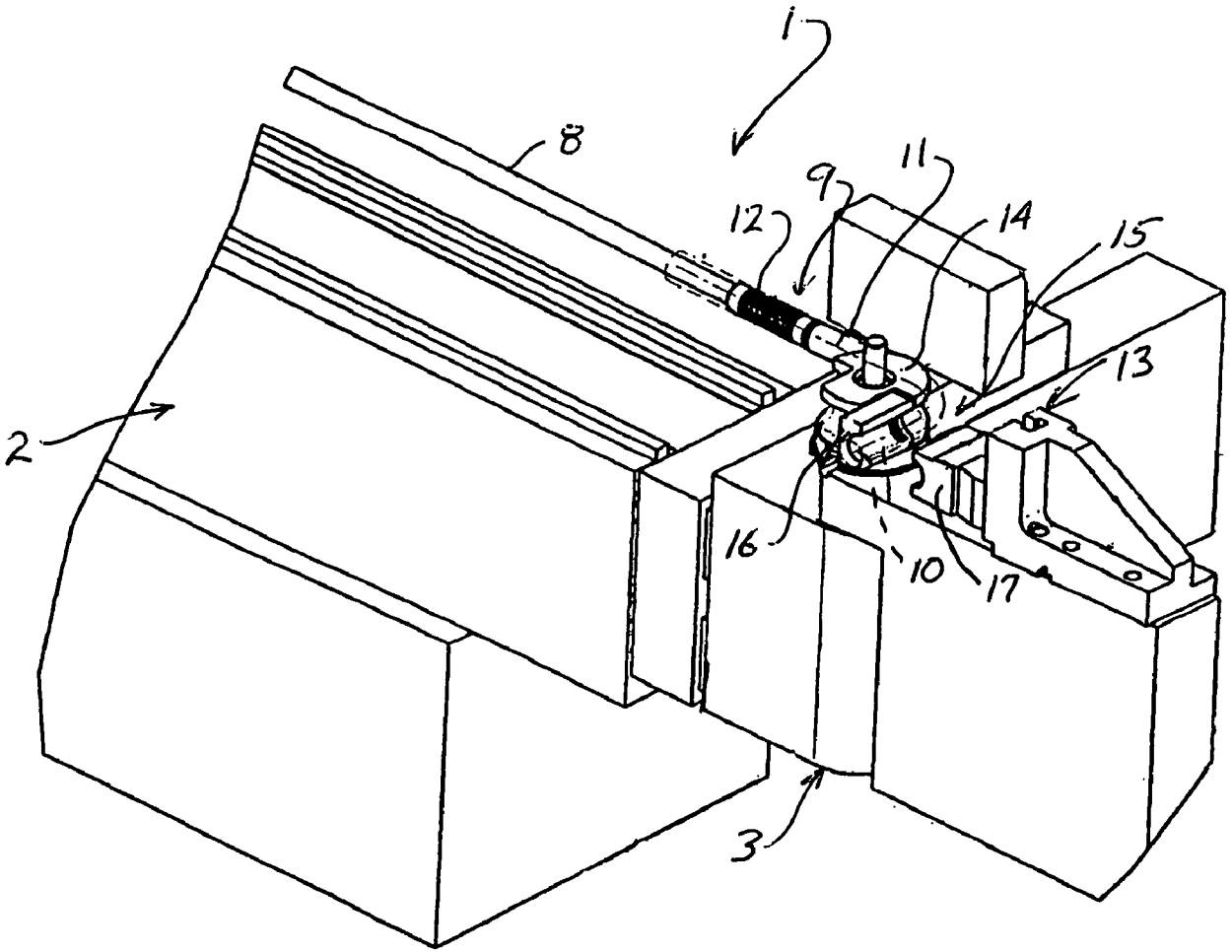

In FIG. 11 there is shown the end of bending of the tube 10 and the opening of the jaws 16 and 17 of the gripping jaws 15. The bending arm 4 is still in position pivoting about the bending head 3. The gripping device 9 and more particularly the gripper 12 is open or inflated to be pressed against the internal wall of the tube 10 and to grip this latter.

Figure 12:
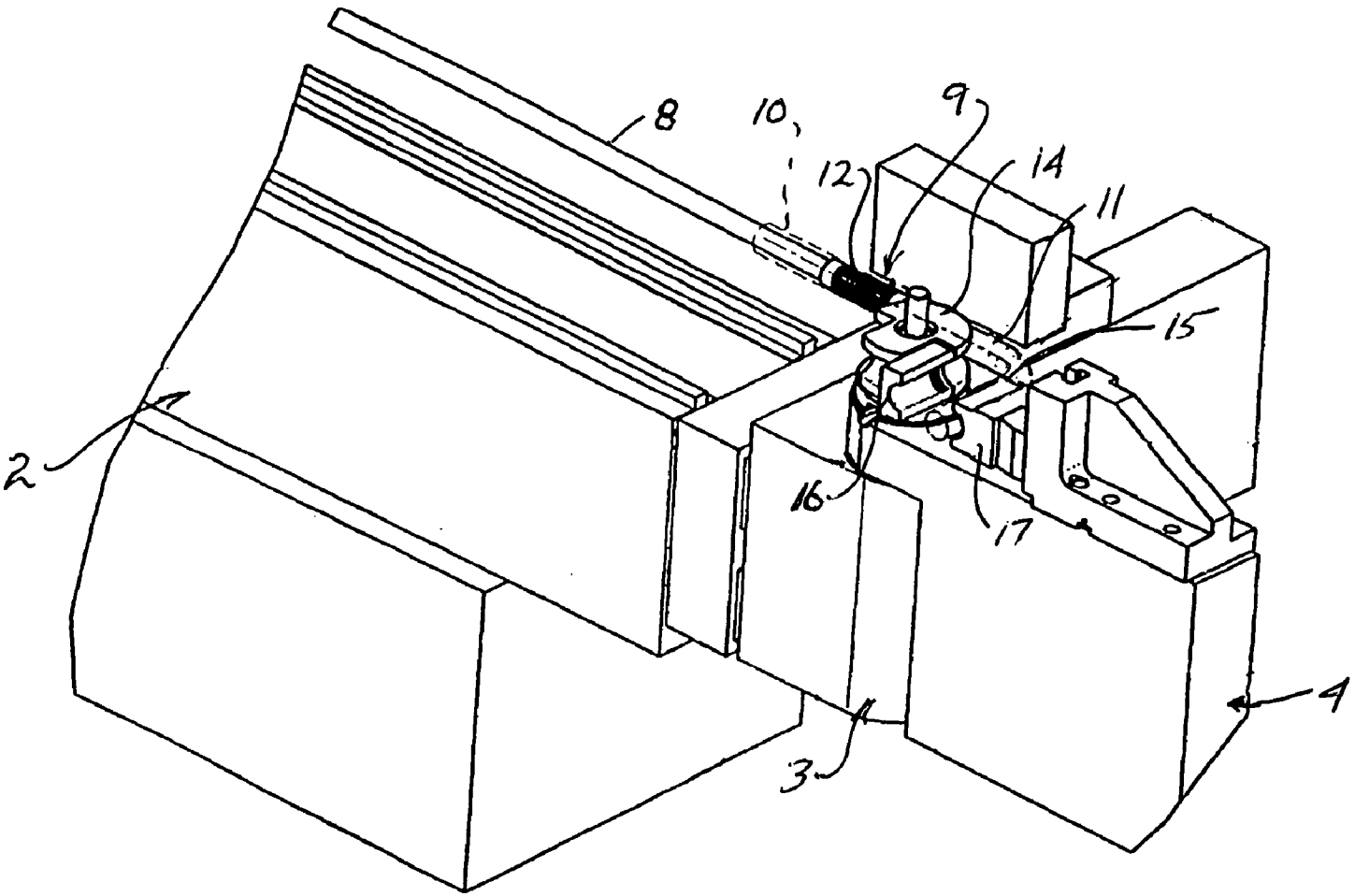

In FIG. 12, the longitudinal movement of the tube 10 is shown to disengage it from the jaw 16 of the gripping jaws 15 when the gripper 12 is expanded to grip the tube. The movement of the tube 10 is carried out by means of the movable carriage 6 which slides, by means of the gear of motor reducer 21, along the rails 5 of the frame 2 in the direction of the bending head 3. Thus, the movement of the carriage 6 gives rise simultaneously to the movement of the carrying bar 8 that is secured to the gripping device 9 and thus to by the mandrel and the griper 12 gripped within the tube 10.

It will be noted that the gripping machine 1 comprises a movable carriage 6 common to the gripping means (12) and to the mandrel (11) of the gripping device 9 to permit the movements of the tube 10.

It should also be understood that the preceding description has been given only by way of example and that it in no way limits the scope of the invention from which one will not depart by replacing details of execution described by any other equivalent.

The invention claimed is:

1. A device for moving and retaining a tube (10) to be bent relative to a bending head (3) supported by a frame (2) of a bending machine(l), the device comprising; a mandrel (11) secured to gripping means (12) that is selectively applied against an internal wall of the tube (10) to be bent, movement means (6), connecting means for connecting said movement means to said mandrel (11) and said gripping means (12), and said gripping means being selectively engageable to grip the internal wall of the tube and thereby connect the tube to said movement means to permit longitudinal translation and rotation of the tube by said movement means and being selectively disengageable relative the internal wall the tube to permit said movement means to adjustably position said gripping means and said mandrel within the tube such that the tube is not adversely deformed during bending.

2. The device of claim 1 wherein said connecting means is a carrying bar (8) on which said gripping means and said mandrel are supported.

3. The device of claim 1 wherein said gripping means are constituted by an expansible member that can be deformed by a hydraulic or pneumatic control means so as to exert a pressure against the internal wall of the tube (10) to thereby connect the tube to said movement means.

4. The device of claim 3 wherein said expansible member is constituted by fingers (23) movable outwardly to increase an external diameter of said gripper means.

5. The device of claim 1 said gripping means (12) is constituted by a sealed envelope (24) of resiliently deformable material that can be acted upon to increase an external diameter of said gripping means.

6. The device of claim 1 wherein said mandrel (11) is constituted by a solid bar (18) secured at one of its ends to cups (19) for supporting the internal wall of the tube to thereby prevent deformation of the tube (10) during its bending.

7. The device of claim 6 wherein said solid bar (18) of said mandrel (11) is secured at an opposite end thereof to said gripping means (12).

8. The device of claim 6 wherein said solid bar (18) of said mandrel (11) is secured at an opposite end to to a connection bar (20) that connects to said gripping means (12).

9. A tube bending machine for bending a tube (10), the bending machine comprising; a frame, a bending mechanism mounted on said frame that includes a bending head (3), having a bending roller (14), and a bending arm (4), a device for moving and retaining the tube to be bent relative to said bending head (3) and said bending arm (4), said device including a movement means (6) mounted on said frame in spaced relationship to said bending mechanism, a mandrel (11) secured to gripping means (12), said gripping means being selectively applied against an internal wall of the tube to be bent, connecting means for connecting said movement means to said mandrel and said gripping means, and said gripping means being selectively engageable to grip the internal wall of the tube and thereby connect the tube to said movement means to permit longitudinal translation and/or rotation of the tube by said movement means and being selectively disengageable relative the internal wall the tube to permit said movement means to adjustably position said gripping means and said mandrel within the tube such that the tube is supported internally by said mandrel so as not to be adversely deformed during bending.

* * * * *